United States Patent [19]

Takahashi et al.

[11] 4,144,675

[45] Mar. 20, 1979

[54] APPARATUS FOR TREATING TOP ENDS OF FLEXIBLE CORDS

[75] Inventors: Hiroshi Takahashi, Yokohama; Yasutami Muto, Ageo; Hiroshi Suzuki, Sagamihara; Shiro Fukuda, Urawa, all of Japan

[73] Assignees: Lion Hamigaki Kabushiki Kaisha; K. T. Manufacturing Co., Ltd., both of Tokyo, Japan

[21] Appl. No.: 796,113

[22] Filed: May 11, 1977

[30] Foreign Application Priority Data

May 12, 1976 [JP] Japan ..... 51-53981

[51] Int. Cl.[2] ..... B24B 19/00

[52] U.S. Cl. ..... 51/76 R; 51/138; 51/DIG. 17; 300/17

[58] Field of Search ..... 51/71, 72 R, 74 R, 76 R, 51/137, 138, DIG. 17; 300/17

[56] References Cited

U.S. PATENT DOCUMENTS

| | | | |
|---|---|---|---|
| 1,888,675 | 11/1932 | Izawa | 51/DIG. 17 |
| 2,227,126 | 12/1940 | Cooke | 51/DIG. 17 |
| 2,669,075 | 2/1954 | Dreyfus | 300/17 X |
| 2,685,477 | 9/1954 | Baumgartner | 51/DIG. 17 |
| 3,451,173 | 6/1969 | Hazelton | 300/17 |
| 3,619,953 | 11/1971 | Hosoya | 51/138 X |

*Primary Examiner*—Nicholas P. Godici

*Attorney, Agent, or Firm*—Blum, Moscovitz, Friedman & Kaplan

[57] ABSTRACT

The present invention provides an apparatus for treating the top ends of flexible cords or filaments. It comprises holding means for holding articles having flexible cords, delivery means for delivering said holding means in a predetermined direction, cylindrical grinding means disposed at a position adjacent to a delivery passage for delivering said holding means, and means for rotating said cylindrical grinding means around its own axis and around an axis at right angles to its own axis. By virtue of the feature that the cylindrical grinding means is rotated around its central axis and around the axis rectangularly crossing the central axis, the top ends of flexible cords, such as bristles of toothbrushes, can be polished and ground from all the directions and very smooth and round outer ends can be obtained at high efficiency and high rate. This effect can be further enhanced when a plurality of such cylindrical grinding members are disposed so that rotation directions of every two adjacent cylindrical grinding means are reversed to each other.

7 Claims, 9 Drawing Figures

APPARATUS FOR TREATING TOP ENDS OF FLEXIBLE CORDS

BACKGROUND OF THE INVENTION

The present invention relates to an apparatus for polishing and rounding the outer ends of flexible filaments or cords in the form of a bundle such as brush bristles.

Brush bristles may come from a variety of sources such as animals or extruded filaments. Whatever the source, it is customary for one end of the bristle or cord or filament to be inserted in a mount of some sort. The outer end, which may be referred to as the top end, may be irregular in shape or may be sharp as when the filament consists of a relatively short section cut from a length of extruded fiber. Needless to say, a sharp edge on the end of a toothbrush fiber or bristle can cause severe damage to the gums of the user so that such an end would be most unacceptable.

In view of the fact that the ends of cords or filaments or bristles as purchased are uncontrolled with respect to the shapes thereof, it is evident that apparatus and method for shaping such ends to a desired form where such shaping can be carried out reliably, rapidly and at low cost is highly to be desired.

SUMMARY OF THE INVENTION

In accordance with the present invention bristles, flexible cords or filaments made up into brushes or the like are attached to a delivery system such as a conveyor belt. The delivery device is provided with drive means which carry the brushes or the like past at least one grinding wheel so positioned that the ends of the flexible cords make contact with the cylindrical face of the grinding wheel.

The grinding wheel has a central axis about which it rotates. In addition, the grinding wheel rotates about an axis perpendicular to its central axis. Since the grinding wheel, in its rotation about its central axis tends to bend the flexible cords, the grinding wheel makes contact with the region immediately adjacent the end of each bristle as well as with the end of each bristle. Moreover, since the grinding wheel rotates about a second axis which is perpendicular to the central axis of the grinding wheel, the grinding surface makes contact with the complete periphery of each bristle adjacent the end thereof. As a result, the ends of each flexible cord are rounded uniformly, and all sharp edges are completely and reliably removed.

It may be noted that the second axis about which the grinding wheel rotates, namely the axis which is perpendicular to the central axis of said grinding wheel, is essentially parallel to the direction of the cords or filaments when unflexed. Further, in general, it is preferable to utilize a plurality of grinding wheels rather than a single grinding wheel, although a single grinding wheel can provide substantially satisfactory results with respect to rounding of the ends of the cords or filaments or bristles. However, the use of a plurality of grinding wheels makes for more rapid and more reliable production. In general, where a plurality of grinding wheels is used, adjacent grinding wheels should rotate in opposite directions for best results.

Accordingly, an object of the present invention is an apparatus for polishing and rounding the outer ends of flexible cords mounted or held in bundles.

A further object of the present invention is an apparatus utilizing cylindrical grinding wheels rotating about a central axis and, in addition, about an axis perpendicular to the central axis for effecting uniform rounding about the complete periphery adjacent the outer ends of bristles or flexible cords or filaments.

An important object of the present invention is an apparatus for rounding and polishing uniformly the ends of toothbrush bristles at high rate, it being imperative that all sharp edges be removed.

A significant object of the present invention is a method of rounding and polishing the ends of bristles, flexible cords and filaments at high rate and at low cost.

Still other objects and advantages of the invention will in part be obvious and will in part be apparent from the specification.

The invention accordingly comprises the several steps and the relation of one or more of such steps with respect to each of the others, and the apparatus embodying features of construction, combination of elements and arrangement of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
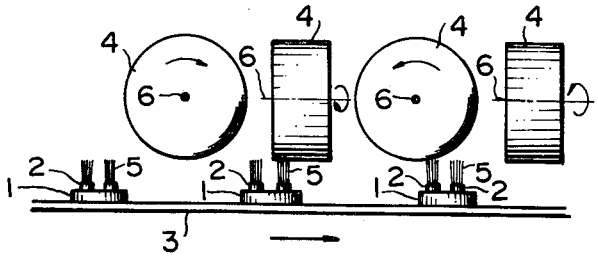
FIG - 1 PRIOR ART
FIG. 1 is a view illustrating a conventional apparatus for treating the outer or top ends of flexible cords.
Figure 2:
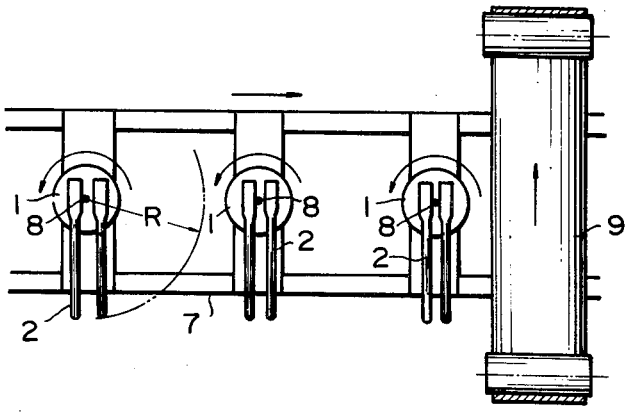
FIG - 2 PRIOR ART
FIG. 2 is a view illustrating another conventional apparatus for treating the top ends of flexible cords.
Figure 3:
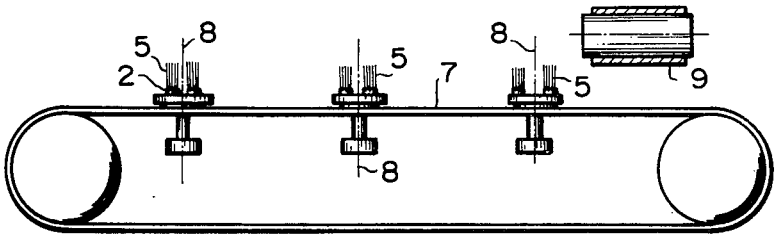
FIG - 3 PRIOR ART
FIG. 3 is a side view of a portion of the apparatus of FIG. 2.

According to the conventional method for polishing and rounding top or outer ends of flexible cords, for example, bristles of toothbrushes, as illustrated in FIG. 1, a toothbrush 2 attached to a holder 1 is passed below cylindrical grinders 4 by a conveyor belt 3 and during this passage, the outer ends 5 of bristles are polished and rounded by the cylindrical grinders 4. Central axes 6 of some cylindrical grinders 4 are parallel to the direction of travel of belt 3 and those of the remaining cylindrical grinders 4 are arranged at right angles to said direction, as shown in FIG. 1. Further, the rotation directions of the cylindrical grinders 4 of each group are reversed to each other. Accordingly, while the toothbrush 2 is being passed through these cylindrical grinders 4, the top ends of bristles 5 are polished from front and rear and from right and left so that said ends are somewhat rounded. However, since polishing is effected only from the four directions, the top ends of bristles come to have a pyramid-like shape, and there is brought about a defect that the top ends are not completely smooth. As means for overcoming this defect, there has been developed an apparatus as shown in FIGS. 2 and 3. When this apparatus is employed, a toothbrush 2 is attached to a holder 1 rotating around a vertical axis 8 on a delivery conveyor 7, and the toothbrush 2 is delivered while being rotated and is passed below a polishing belt 9. Since the top ends 5 of bristles of the toothbrush 2 are polished from all the directions, therefore, the top ends 5 of bristles of the toothbrush 2 can be smoothened and rounded. According to this polishing system, however, since toothbrushes 2 are rotated around vertical axes 8, every two adjacent holders 1 must be spaced from each other at least by a distance R which corresponds to the length of the toothbrushes 2 as shown in FIG. 2. Accordingly, the number of toothbrushes 2 attached along a unit length of the delivery conveyor 7 is limited and the rate of productivity is very low. Further, since a rotation mechanism for the holder 1 is located on the conveyor 7 which is a moving member, shaking and vibration are readily caused. Moreover, it is very difficult to control the delivery speed and the rotation speed independently.

The present invention will now be described by reference to embodiments in which top ends of bristles of toothbrushes are treated. However, as will be apparent to those skilled in the art, the present invention may be applied to not only the treatment of top ends of toothbrushes but also the top end treatment of other articles having flexible filaments or cords in the form of a bundle, such as clothes brushes, blacking brushes, wire brushes, painting brushes and the like.

Figure 4:
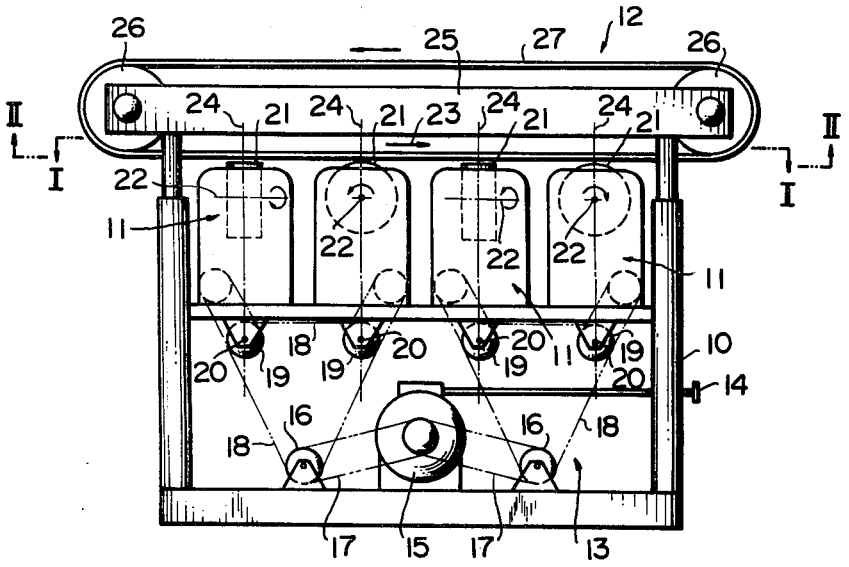
FIG. 4 is a side view showing one embodiment of the apparatus of the present invention for treating top ends of flexible cords.
Figure 5:
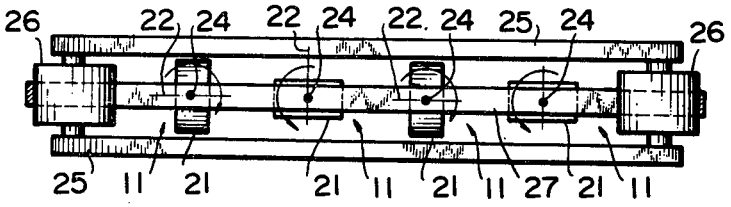
FIG. 5 is a view taken along line I—I of FIG. 4.
Figure 6:
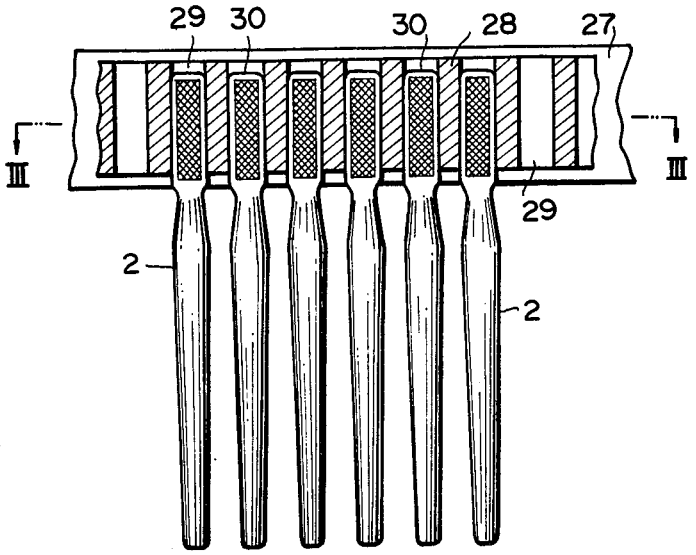
FIG. 6 is an enlarged view taken along the line II—II of FIG. 4.
Figure 7:
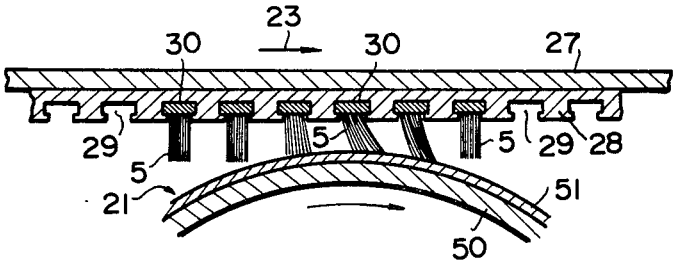
FIG. 7 is a view showing the section taken along the line III—III of FIG. 6.

Referring now to FIGS. 4 and 5, four sets of grinder devices 11 are mounted on an intermediate stage of a frame 10, a toothbrush conveyor belt 12 is mounted on an upper stage of the frame 10, and a driving device 13 for driving the grinding devices 11 is mounted on a lower stage of the frame 10. The driving device 13 comprises a variable speed motor 15 the speed of which can be changed by the operation of a handle 4, a fixed pulley 16 and belts 17 and 18. The driving device 13 rotates a pulley 19 of each grinder device 11 to turn a horizontal shaft 20. A cylindrical grinder 21 is disposed in the upper portion of each grinder device 11. The grinder device 11 is arranged so that as detailed hereinafter, by rotation of the horizontal shaft 20, the cylindrical grinder 21 is rotated around a central axis 22 and also around a vertical axis 24 at right angles to the central axis 22. As shown in FIG. 5, in four sets of the grinder devices 11, the direction of the rotation of two grinder devices around the central axes 22 thereof is reversed to that of the other two grinder devices. The conveyor belt, i.e., delivery device 12, is supported on the upper portion of the frame 10 so that it can be moved in the vertical direction, thereby locating the bristles or cords at the optimum distance from the grinders 21. The delivery device 12 comprises a beam 25, pulleys 26 and a delivery belt 27 which is driven according to a known method by another driving system (not shown). A holder 28 as shown in FIGS. 6 and 7 is disposed on the surface of delivery belt 27. This holder 28 is molded from a flexible material such as rubber and has a large number of parallel grooves 29 in the surface thereof extending transverse to the delivery direction. Each of the grooves 29 is a dovetail groove and grips therein the bristle-planted portion 30 of a toothbrush 2. Each cylindrical grinder 21 is located, as shown in FIG. 7, so that it touches and polishes bristles 5 of toothbrushes 2 as said toothbrushes are carried past the grinder by the holder 28. The distance between the delivery belt 27 and the cylindrical grinder 21 is changed depending on the sizes of toothbrushes and bristles, and this change is accomplished by a known lift mechanism (not shown; for example, a screw or a hydraulic cylinder) mounted on the bearing portion of delivery device 12 disposed on the top end of the frame 10.

Figure 8:
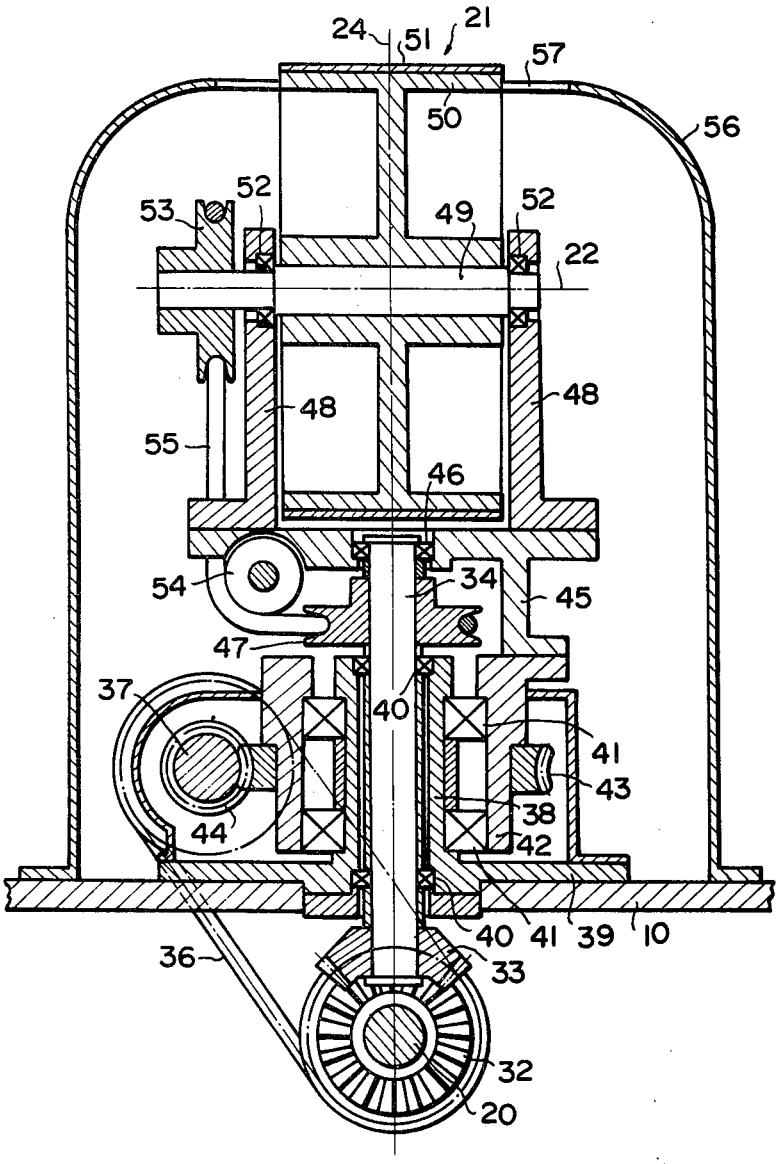
FIG. 8 is a sectional side view of a grinder portion of the apparatus of the present invention.
Figure 9:
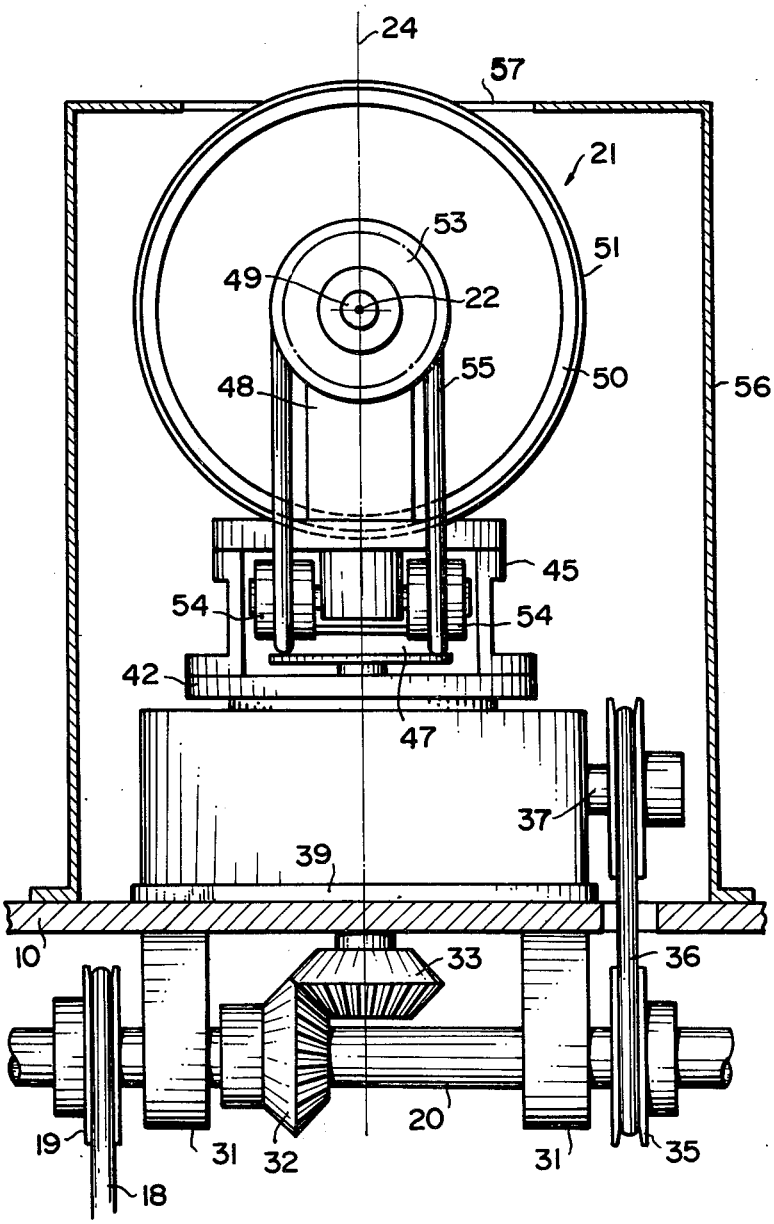
FIG. 9 is a front view of the grinder shown in FIG. 8.

Referring now to FIGS. 8 and 9 for a description of the grinder device 11, horizontal shaft 20 is rotatably supported on the frame 10 by bearing 31. Vertical shaft 34 is rotated through bevel gear 33 by bevel gear 32 mounted on the horizontal shaft 20, and worm shaft 37 is rotated through a belt 36 by a pulley 35. Hollow housing 38 is attached to the frame 10 by flange 39, and the vertical shaft 34 is rotatably supported inside housing 38 through bearing 40 and a boss portion 42 is rotatably supported outside the housing 38 through a bearing 41. A worm wheel 43 is mounted outside the boss portion 42 and it is engaged with a worm 44 on worm shaft 37. A stand frame 45 is disposed above the boss portion 42 to support the top end of the vertical shaft 34 provided with a pulley 47 through a bearing 46. A lateral shaft 49 including central axis 22 of the cylindrical grinder 21 is rotatably supported on the stand frame 45 by a bracket 48 through a bearing 52.

The cylindrical grinder 21 comprises a pulley 50 and a grinding band 51 disposed on the surface of the pulley 50, and the cylindrical grinder 21 is rotated around the lateral shaft 49. A pulley 53 is attached to the lateral shaft 49. A belt 55 of which the direction is changed by a roller 54 is positioned between the pulley 53 and the pulley 47. Reference numeral 24 represents a vertical axis which coincides with the central axis of the vertical shaft 34. Cover 56 has therein an opening 57 of shape and size such as to prevent the cylindrical grinder 21 from hitting the cover 56 when it rotates around the rectangular axis 24.

The functions and effects of the embodiment having the above illustrated structure will now be described. The motor 15 is adjusted by the handle 14 to a suitable speed and the horizontal shaft 20 in each grinder is rotated through belts 17 and 18. As shown in FIGS. 8 and 9, by rotation of the horizontal shaft 20, the worm 44 is rotated through the pulley 35 and the belt 36, causing the worm wheel 43 to rotate at speed lower than that of the pulley 50, and the cylindrical grinder 21 is rotated around the vertical axis 24 rectangularly crossing the central axis 22 through the boss portion 42, stand frame 45 and bracket 48. At this time, the central axis 22 per se of the cylinder is rotated around the vertical axis 24 rectangularly crossing the central axis 22 in the horizontal plane, namely in the parallel to the plane of the locus of the top ends of bristles in the delivery direction of the toothbrushes. Further, by rotation of the horizontal shaft 20, the pulley 53 is rotated through the bevel gears 32 and 33, vertical shaft 34, pulley 47 and belt 55, and the cylindrical grinder 21 is rotated around the central axis 22. Namely, by rotation of the horizontal shaft 20, the cylindrical grinder 21 is rotated simultaneously both around the central axis 22 and around the vertical axis 24 rectangularly crossing the central axis 22.

Four sets of such cylindrical grinders 21 are thus rotated, the height of the delivery device 12 is adjusted appropriately, as shown in FIGS. 4 and 5, and the operation of delivery belt 27 is started. Then, by using another feed mechanism (not shown) or by manual operation, toothbrushes 2 are inserted into the grooves 29 of the holder 28. With movement of the delivery belt 27, the toothbrushes 2 are transported, and when they arrive just above the cylindrical grinder 21, the outer ends of bristles 5 are polished as shown in FIG. 7.

FIG. 7 illustrates the case where band 51 on the cylindrical grinder 21 moves in the delivery direction 23, but since the speed of band 51 is higher than that of the delivery belt 27, the bristles are squeezed to the right and polished and ground. While one toothbrush is delivered from a point where the outer ends of the bristles 5 begin to make contact with the cylindrical grinder 21 to a point where they separate from the cylindrical grinder 21, the grinder 21 is rotated around the vertical axis 24 two or three times. Accordingly, the bristle ends are polished and ground from all sides. Then, the toothbrush 2 is delivered to the next cylindrical grinder 21 and is similarly polished and ground again. In this manner, the toothbrush 2 is subjected to the polishing operation by the four cylindrical grinders 21. Moreover, the directions of rotations around the vertical axes 24 rectangularly crossing the central axes 22 are reversed alternately in these four cylindrical grinders 21, as shown in FIG. 5. Accordingly, the outer ends of the bristles 5 are polished and ground from all directions, and the outer end portions of the bristles 5, namely the ends themselves and the adjacent portions of the bristles, can be uniformly polished and ground from all directions. Therefore, the outer ends of the bristles 5 can be rounded very smoothly.

As will be apparent from the foregoing illustration, only the cylindrical grinders 21 are rotated but the toothbrushes are not rotated. Accordingly, the toothbrushes 2 can be arranged very densely at the minimum pitch necessary for holding, as shown in FIG. 6. Therefore, the number of toothbrushes 2 or other articles fitted with filaments or cords that can be delivered along a unit length of the delivery belt 27 is several times to about 10 times the delivery number in the conventional apparatus, and the manufacturing efficiency can be enhanced and the mass production can be performed effectively. Moreover, since the moving member does not include a rotating element, the operation can be conducted very stably without shakings or vibrations. Still further, optimum treatment conditions can easily be attained by controlling the delivery speed and rotation speed appropriately.

Further, among the cylindrical grinders 21, the grain size of the grinding surface or the height may be changed, or the gap from the toothbrushes can also be changed. Furthermore, the rotation speed may be changed among the cylindrical grinders 21 by changing the pulley diameter. By these arrangements, optimum operation conditions can easily be attained and best finishes can be obtained.

Although FIGS. 4 and 5 show a plurality of grinders, moderately satisfactory results can be achieved by a single grinder so constructed as to rotate around an axis perpendicular to the direction of motion of the grinding surface making contact with the filament or bristle to be rounded.

Instead of the foregoing driving system including belts, bevel gears and worms, there may be employed other various known driving systems including gears, belts and the like. When timing belts are used, generation of noises can be drastically reduced during the operation.

The specification of the apparatus is, for example, as follows:

| | |
|---|---|
| Rate of rotation around the central (usually horizontal) axis of the cylindrical grinder | 10 to 1000 rpm |
| Rate of rotation around the axis perpendicular to the axis of the cylindrical grinder | 3 to 300 rpm |
| Grain size of grinder | No. 100 to No. 1200 |

The delivery direction need not be in the horizontal direction, but toothbrushes or the like may be delivered in the vertical direction. In this case, the central axis of the cylinder rotates in a vertical plane and the other axis (corresponding to the rectangular axis) extends in the horizontal direction, and a plurality of cylindrical grinders are arranged in the vertical direction.

Even when the delivery is effected in the horizontal direction, the face of the delivery belt 27 may be vertical. In this case, the posture of each cylindrical grinder is the same as described above, but a plurality of the cylindrical grinders are arranged in the horizontal direction.

As will be apparent from the foregoing illustration, the apparatus of the present invention comprises a plurality of brush holders delivered by the delivery device, these holders having a holding member for holding brushes in a direction substantially rectangular to the delivery direction, a cylindrical grinder is disposed at a position where outer ends of bristles of the delivered brushes make contact with the grinder, and the cylindrical grinder is constructed so that it is rotated not only around the central axis of the cylinder but also around an axis at right angles to the central axis. By virtue of this specific structure, not only the top or outer ends but also the neighboring parts of bristles of brushes are uniformly polished and ground from all the directions, and bristles having very smooth and round top ends can be obtained. Moreover, since the brushes can be delivered very densely at very short pitches and the number of the brushes to be delivered along a unit delivery length can be much increased over the conventional technique, the productivity and manufacturing rate can be remarkably enhanced and the mass production can be performed at high efficiency. Still further, the operation can be conducted very stably without shakings or vibrations. Furthermore, since the delivery speed and rotation speed can be controlled independently, optimum conditions can be established very easily. Thus, the apparatus of the present invention presents economic advantages in its high rate of production and is extremely effective in achieving the desired shaping of the outer ends of flexible cords, filaments and bristles.

It will thus be seen that the objects set forth above, among those made apparent from the preceding description, are efficiently attained and, since certain changes may be made in carrying out the above method and in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

What is claimed is:

1. An apparatus for treating the outer ends of flexible cords comprising holding means for holding articles having flexible cords, continuously delivery means for delivering said holding means in a predetermined direction, a plurality of motor-driven cylindrical grinding means each having a central axis, each of said cylindrical grinding means being disposed at a position adjacent said holding means, and means for continuously rotating each of said cylindrical grinding means around said central axis thereof and around an axis perpendicular to said central axis, said cylindrical grinding means being arranged so that directions of rotation of every two adjacent cylindrical grinding means around said axes perpendicular to said central axes are reversed with respect to each other.

2. An apparatus as set forth in claim 1, wherein said cylindrical grinding means are arranged so that directions of rotations of every two adjacent cylindrical grinding means around the central axes thereof are reversed with respect to each other.

3. An apparatus as set forth in claim 1, wherein said holding means is a band-like member continuous with respect to the delivery direction and having a plurality of parallel grooves extending in a direction substantially rectangular to the delivery direction in said band-like member for holding therein articles having flexible cords.

4. An apparatus as set forth in claim 1, further comprising means for adjusting the distance between said holding means and said grinding means.

5. An apparatus as set forth in claim 1, wherein a single means is disposed for effecting rotation of said cylindrical grinding means about said central axis and about said axis perpendicular to said central axis.

6. An apparatus as set forth in claim 1, wherein said delivery means is disposed for moving in a horizontal direction past said cylindrical grinding means.

7. An apparatus as set forth in claim 1, wherein said delivery means is disposed for moving in a vertical direction past said cylindrical grinding means.

* * * * *